US008727898B2

(12) United States Patent
Kanemaru et al.

(10) Patent No.: US 8,727,898 B2
(45) Date of Patent: May 20, 2014

(54) LARGE-QUADRUPEDAL-ANIMAL COSTUME SUIT

(75) Inventors: Kazuya Kanemaru, Higashikurume (JP); Akemi Kozuka, Higashikurume (JP)

(73) Assignee: On-Art Corporation, Tokyo (JP)

( * ) Notice: Subject to any disclaimer, the term of this patent is extended or adjusted under 35 U.S.C. 154(b) by 77 days.

(21) Appl. No.: 13/639,570

(22) PCT Filed: Oct. 30, 2011

(86) PCT No.: PCT/JP2011/075010

§ 371 (c)(1),
(2), (4) Date: Oct. 5, 2012

(87) PCT Pub. No.: WO2012/077428

PCT Pub. Date: Jun. 14, 2012

(65) Prior Publication Data

US 2013/0023351 A1 Jan. 24, 2013

(30) Foreign Application Priority Data

Dec. 6, 2010 (JP) ..... 2010-271132

(51) Int. Cl.
*A63J 5/02* (2006.01)
*A63H 33/00* (2006.01)

(52) U.S. Cl.
USPC ..... 472/84; 472/133; 446/26

(58) Field of Classification Search
USPC ..... 472/70, 83, 84, 133; 446/26–28; 297/181; 280/1.22, 1.23; 2/311
See application file for complete search history.

(56) References Cited

U.S. PATENT DOCUMENTS

| | | | | | |
|---|---|---|---|---|---|
| 695,903 | A | * | 3/1902 | Braaatz | 472/84 |
| 1,252,257 | A | * | 1/1918 | Fritsche | 472/84 |
| 1,766,116 | A | * | 6/1930 | Ellinger | 472/84 |
| 1,898,587 | A | | 2/1933 | Messmore | |
| 2,176,936 | A | * | 10/1939 | Sullivan | 472/84 |
| 2,938,725 | A | * | 5/1960 | Vanause | 472/84 |
| 7,997,991 | B2 | * | 8/2011 | Kanemaru et al. | 472/84 |

FOREIGN PATENT DOCUMENTS

| | | |
|---|---|---|
| JP | 4295297 B2 | 7/2009 |
| WO | 2009/037741 A1 | 3/2009 |

OTHER PUBLICATIONS

Tokyo Venture Technology Award 2009 (New Ventures Support Section, Commerce and Industry Division, Bureau of Industrial and Labor Affairs, Tokyo Metropolitan Government, issued in 2009).

* cited by examiner

*Primary Examiner* — Kien Nguyen
(74) *Attorney, Agent, or Firm* — Sughrue Mion, PLLC

(57) ABSTRACT

A large-quadrupedal-animal costume suit modeled after a large quadrupedal animal, the costume suit having a head and mouth part, a neck part, a body part, a foreleg part, a hind leg part, and a tail part and being configured, as a whole, a skeletal member and a skin member covering the skeletal member, wherein the body part, the foreleg part, and the hind leg part communicate with each other to form a single hollow, the hollow has a size allowing a foreleg operator fitting in the foreleg part and a hind leg operator fitting in the hind leg part to fit in as standing upright. Frame-pack support members for the foreleg operator and the hind leg operator are installed in the hollow as being fixed to the skeletal member at the body part, and a frame pack for the foreleg operator and a frame pack for the hind leg operator are provided to the frame-pack support members so as to face each other. The large-quadrupedal-animal costume suit capable of making a realistic movement is provided.

10 Claims, 3 Drawing Sheets

LARGE-QUADRUPEDAL-ANIMAL COSTUME SUIT

CROSS REFERENCE TO RELATED APPLICATIONS

This application is a National Stage of International Application No. PCT/JP2011/075010 filed Oct. 30, 2011, the contents of which are incorporated herein by reference in their entirety.

TECHNICAL FIELD

The present invention relates to a costume suit modeled after a large quadrupedal animal and capable of making a realistic movement, and particularly relates to an internal structure thereof.

BACKGROUND ART

A costume suit refers to a large human-wearable costume. The costume suit is made of special clothing or material, covering a whole body of a person inside to make the person transform into a fictitious creature, such as an anthropomorphized animal or monster. For such a representation, the costume suit is widely used in various events, entertainment shows in amusement parks, TV programs, and others.

On the other hand, a full-scale restoration model of a large animal such as a dinosaur is often presented for exhibit in various fairs, museums, and others. When moving images of a large animal are needed, realistic movements can be achieved nowadays with computer graphics (CG), which are frequently used to create special effects for movies and others. However, when realistic movements of a large animal are needed in amusement parks, theme parks, or theatrical performances on stage, a full-scale costume suit is needed.

Conventionally, since a costume suit modeled after a large animal such as a dinosaur has a longitudinally and laterally long and large shape, it is hard to keep balance, and forcible movement incurs the risk of toppling over. Therefore, manufacturing such a costume suit for practical use is difficult. As a result of diligent studies to solve this problem, the inventors have found that, at a position approximately corresponding to a equilibrium point of the costume suit in a hollow formed with a body part and a leg part communicating inside with each other, a frame pack to be carried by an operator who fits in the hollow and operates the costume suit is installed as being fixed to a skeletal part of the costume suit, thereby achieving realistic movements with extremely stable operation even if the costume suit measures approximately six meters in full length, and this invention has been granted patents in various countries (Patent Document 1). However, in the invention described in Patent Document 1, the number of operators who fit in the costume suit is restricted to one. Therefore, the costume suit can be applied only to a bipedal animal. Moreover, if the costume suit becomes larger, its load cannot be supported by a single person and, furthermore, it is difficult to walk around safely.

As far as the inventors know, prior examples describing a method of manipulating a large costume suit hardly exist. There are only few known documents, such as Patent Document 1 describing "the person may operate independently by looking at monitor images of a video camera, which is installed in an adequate position of the costume suit, or may operate by following a direction of an outside conductor via radio communication." and an article introducing the winning of "Tokyo Venture Technology Award 2009" by the product of Patent Document 1 describing "an operator uses two inner monitors and wireless communications to ensure safety" (Non-Patent Document 1).

PRIOR ART DOCUMENTS

Patent Documents

Patent Document 1: International Publication No. 2009/037741

Non-Patent Document 1: Tokyo Venture Technology Award 2009 (New Ventures Support Section, Commerce and Industry Division, Bureau of Industrial and Labor Affairs, Tokyo Metropolitan Government, issued in 2009)

SUMMARY OF THE INVENTION

Problems to be Solved by the Invention

Therefore, an object of the present invention is to provide a large-quadrupedal-animal costume suit capable of making a realistic movement.

Means for Solving the Problems

The present invention is directed to a large-quadrupedal-animal costume suit capable of making a realistic movement and modeled after a large quadrupedal animal, the costume suit having a head and mouth part, a neck part, a body part, a foreleg part, a hind leg part, and a tail part and being configured, as a whole, a skeletal member and a skin member covering the skeletal member, wherein the body part, the foreleg part, and the hind leg part communicate with each other to form a single hollow, the hollow has a size allowing a foreleg operator fitting in the foreleg part and a hind leg operator fitting in the hind leg part to fit in as standing upright, frame-pack support members for the foreleg operator and the hind leg operator are installed in the hollow as being fixed to the skeletal member at the body part, a frame pack for the foreleg operator is installed on the frame-pack support member provided on a head side of the hollow, and a frame pack for the hind leg operator is installed on the frame-pack support member provided on a tail side of the hollow so as to face the frame pack for the foreleg operator.

A feature of the present invention is that, in the costume suit described above, a frame pack for the foreleg operator is installed on the frame-pack support member provided on a head side of the hollow, and a frame pack for the hind leg operator is installed on the frame-pack support member provided on a tail side of the hollow so as to face the frame pack for the foreleg operator. In an embodiment of the present invention, neck-part operating means for operating a movement of the head and mouth part and the neck part is provided. In another embodiment of the present invention, head-and-mouth-part operating means for operating a movement of the head and mouth part is provided. In still another embodiment of the present invention, mouth-part operating means for operating opening and closing of a mouth of the head and mouth part is provided. Other embodiments of the present invention are sequentially described below.

Effects of the Invention

The costume suit of the present invention modeled after a large animal has a hollow formed by the foreleg part, the hind leg part, and the body part, the hollow allowing an adult to fit in the foreleg part as standing upright and an adult to fit in the hind leg part as standing upright, and these two operators share front and rear loads of the costume suit, thereby allowing a larger quadrupedal costume suit to stably move. Also, with role sharing in a manner such that one operator operates the head and mouth part and the neck part and the other operates the tail part, more realistic movements can be achieved compared with the case of operation with a single operator.

According to the present invention, two operators face each other, and therefore better communication can be achieved at the time of operating the costume suit. Furthermore, since forward walking by the foreleg operator is oriented backward, the movement of knee joints of the costume suit more resembles the knee movement unique to a large quadrupedal animal at the time of walking. Also, in another embodiment, it is possible to operate a movement of the head and mouth part and the neck part, a movement of the head and mouth part, or opening and closing of the mouth of the head and mouth part, thereby achieving a more realistic movement of the large quadrupedal animal.

DESCRIPTION OF EMBODIMENTS

Figure 1:
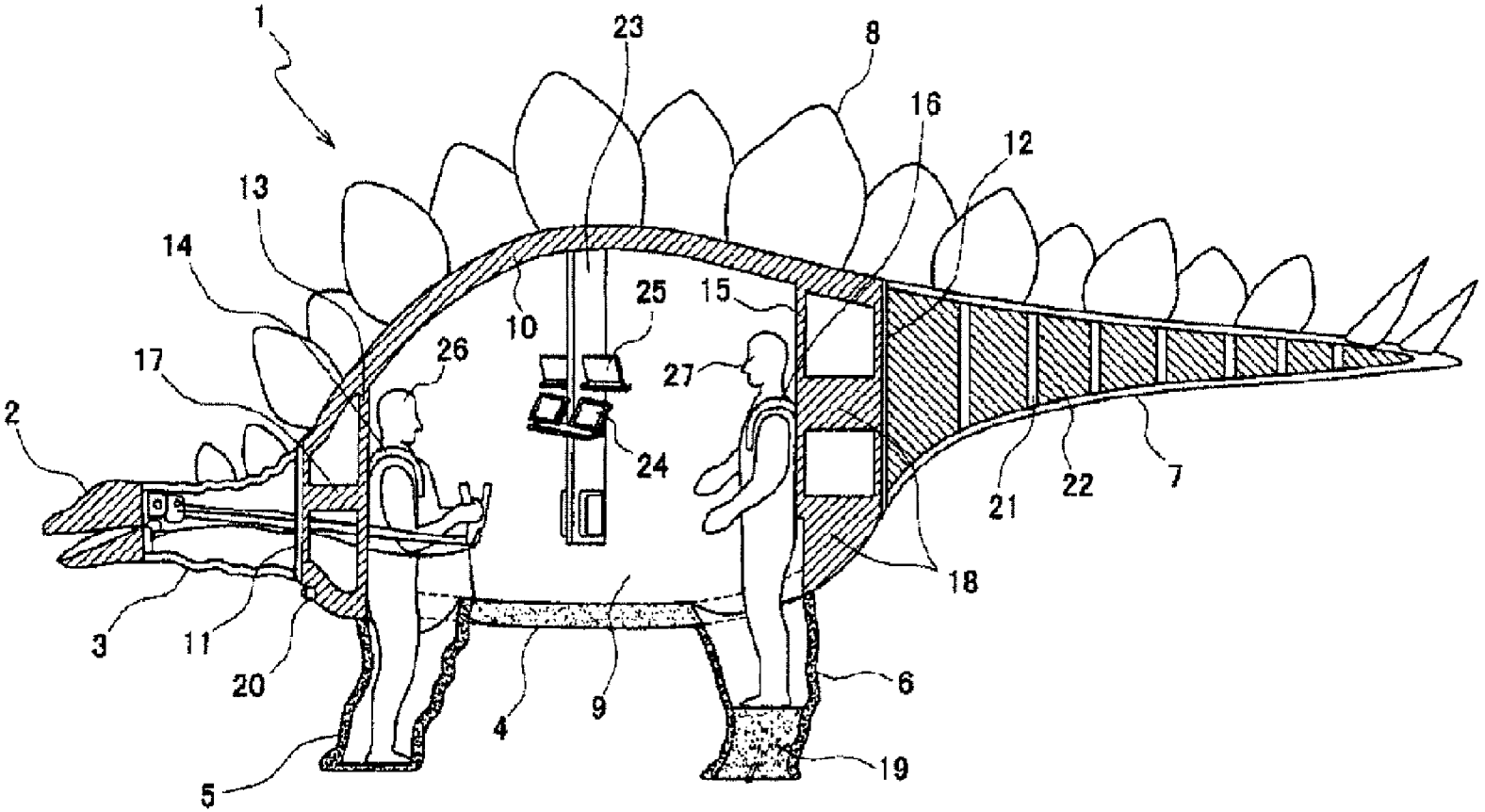
FIG. 1 is a view for describing an overview and inner structure of a quadrupedal-dinosaur costume suit.

The costume suit of the present invention is a costume suit modeled after a large quadrupedal animal, having a head and mouth part, a neck part, a body part, foot parts, and a tail part, and being configured of a skeletal member forming an outer shape as a whole and outer skin member covering the skeletal member. The large animal may be an existent animal, a fictitious animal such as any of various characters and monsters, or an animal whose existence is scientifically supported, such as a dinosaur. A large four-legged walking animal is preferable, and even a large more-legged walking animal can be adopted as long as the animal can make four-legged walking.

The structure of the skeletal member is not particularly restrictive as long as the skeletal member can form and keep the outer shape of a head part, a neck part, a body part, a foreleg part, a hind leg part, and a tail part, but the skeletal member is required to be configured so that its overall weight is light by using the lightest possible material. Examples of the material of the skeletal member include natural materials such as wood or bamboo; plastics such as polyethylene and polyvinyl chloride; a synthetic-resin foam material made of polystyrene, polyurethane, or the like; FRP using glass fiber, carbon fiber, or the like as a reinforcing material; and lightweight metal such as aluminum.

For example, when the skeletal member at the body part is configured by using wood and a synthetic-resin foam material, a portion corresponding to the backbone and portions corresponding to a coupling surface between the neck part and the body part and a coupling surface between the tail part and the body part are made of wood, and the synthetic-resin form material formed in the shape of the body is bonded to the wood of the backbone portion for fabrication. When reinforcement is required in the skeletal member to keep the outer shape, a reinforcing member in a plate shape, a stick shape, a pipe shape, or the like can be used for reinforcement as appropriate. In that case, that reinforcing member is also included in the skeletal member. When the skeletal member is made of a material excellent in strength, such as a resin reinforced with carbon fiber (CFRP), the body part can also be fabricated with the same material without a distinction between the backbone portion and other portions of the body part. Also, for a portion not exerting a large load on the skeletal member, such as the neck part, a more flexible material can be used for fabrication, such as a sponge-like synthetic-resin foam material, as long as that part has a strength to the extent of allowing the outer shape to be kept.

The material of the skin member is not particularly restrictive as long as the material has a strength so as to be unbreakable with the operation of the costume suite. The material is preferably light and elastic as much as possible. For example, various fabrics, paper, various films, various rubbers, and various foam materials can be used. Among others, a material in combination of an elastic thin film and a foam material such as polyurethane is preferable.

The costume suit of the present invention has a foreleg part and a hind leg part. The body part, the foreleg part, and the hind leg part communicate with each other to form a single hollow. That hollow is required to have a size allowing a foreleg operator fitting in the foreleg part and a hind leg operator fitting in the hind leg part to fit in as standing upright.

In the present invention, frame packs for the foreleg operator and the hind leg operator are each fixed to a frame-pack support member at a position where the operator standing upright carries the pack on his or her back. The frame pack for the foreleg operator is installed and fixed to a frame-pack support member provided on a head side of the hollow, and the frame pack for the hind leg operator is installed and fixed to a frame-pack support member provided on a tail side of the hollow so as to face the frame pack for the foreleg operator. The frame-pack support members are installed as being fixed to the skeletal member at the body part. When the skeletal member has a backbone made of wood, the frame-pack support members are preferably fixed to that wood of the backbone. Here, if a reinforcing member is mounted between a relevant one of the frame-pack support members and a coupling portion between the body part and the neck part or a coupling portion between the body part and the tail part, the frame-pack support members are more stably fixed. The portion where this reinforcing member is to mounted can be determined as appropriate in consideration of the structure of the body part.

In Patent Document 1, the installation portion of each fame pack is specified at a position approximately corresponding to an equilibrium point of the costume suit, that is, a position equivalent to a fulcrum when the whole costume suit is regarded as a carrying pole. However, in the present invention, the installation portion of the frame pack is self-restrictive based on the positions of the foreleg part and the hind leg part specified by its outer appearance. Even so, in consideration of the positional relation between the foreleg part and the hind leg part and the degree of a raised bottom, the frame packs are preferably installed at positions so that the burden of load is equal as much as possible between two operators.

The frame pack is a carrying device for carryings a baggage on one's back, strapped or placed with shoulder straps or belts. In the present invention, the shape, material, method of fixing to the skeletal part, and others are not restricted in any way, as long as each operator in the hollow carries the costume suit on his or her back with a frame pack. In an example of structure, when the body part and the foreleg part communicating inside with each other and the body part and the hind leg part communicating inside with each other form a single hollow, the frame-pack support members are provided on both of a head side and a tail side of the body part as being coupled to the skeletal member at the body part. In another example of structure, when the body part and the foreleg part communicating inside with each other and the body part and the hind leg part communicating inside with each other form two separate hollows, the frame-pack support members are each provided in a relevant one of these hollows as being coupled to the skeletal member at the body part, and a frame pack is provided to each support member.

Also, when a coupling member in a plate shape, a columnar shape, or the like is provided to a coupling portion of the body part with the neck part or the tail part, depending on the positional relation between the foreleg part and the hind leg part, the coupling member can be used to install a frame pack. In the above description, the coupling member of the body part with the neck part or the tail part has a function as a reinforcing member for keeping the outer shape of the costume suit and, in some cases, can also serve as a frame-pack support member. In this sense, this reinforcing member can be included in the skeletal member, and also can be equivalent to a frame-pack support member.

While two independent hollows can be provided for the foreleg part and the hind leg part in the present invention, it is preferable to provide a single hollow common for both and to install the frame packs so that the foreleg-part operator and the hind-leg-part operator fitting in that hollow face each other to be oriented backward and forward, respectively, because of the following reason. In this preferable case, a frame pack for the foreleg-part operator is provided to the frame-pack support member on a head side of the hollow, and a frame pack for the hind-leg-part operator is provided to the frame-pack support member on a tail side of the hollow. In this implementation, when the costume suit goes forward, the foreleg-part operator goes backward, and therefore the movement of knee joints of the forelegs is more realistic, resembling an actual movement.

In the costume suit of the present invention, the load on the costume suit is shared by two operators fitting therein. Therefore, it is easy to attain a whole balance, and the costume suit is wearable and operable even if the costume suit has a larger size compared with a costume suit operated by a single operator. For example, even if the costume suit measures approximately 10 m to 15 m in full length, the costume suit can be stably operated by two operators.

In the hollow (in the hollow where the operator fits as standing upright) of the costume suit, neck-part operating means operating a movement of the head and mouth part and the neck part, head-and-mouth-part operating means for operating a movement of the head and mouth part, and mouth-part operating means for operating opening and closing the mouth of the head and mouth part can be provided as appropriate. With these means being provided, it is possible to not only move the entire costume suit but also move the head and mouth part and the neck part in an interlocked manner, move the head and mouth part, and open and close the mouth, thereby achieving a more realistic movement of the large animal.

Figure 2:
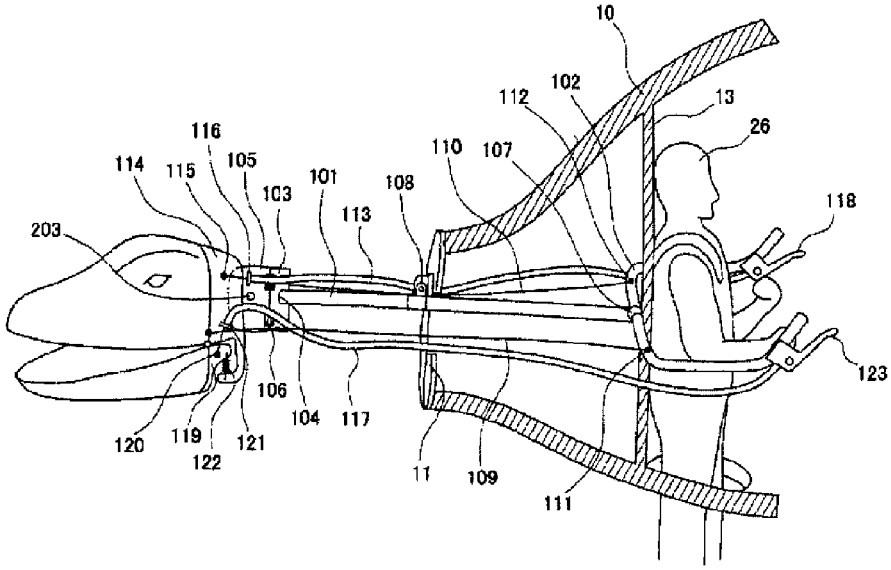
FIG. 2 is a view for describing an example of neck-part operating means, head-and-mouth-part operating means, and mouth-part operating means of the dinosaur costume suit shown in FIG. 1.
Figure 3:
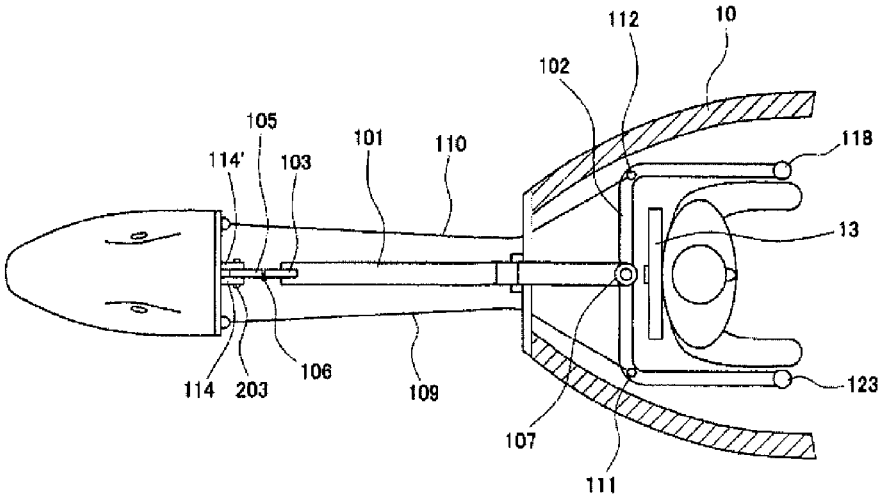
FIG. 3 is a view for describing means operating leftward and rightward movements of a head and mouth part in the head-and-mouth-part operating means shown in FIG. 2.

Preferable neck operating means is configured of an operating arm extending from the neck part to the hollow of the body part and an operation handle coupled to this operating arm, and an example of structure is as shown in FIG. 2. FIG. 2 schematically shows the inside of the neck part and the body part so that how to couple the head and mouth part and the neck part together and the neck part and the body part together and the structure of the neck-part operating means are easily understood. For simplification of the drawing, the skeletal part at the neck part is omitted. In FIG. 2, an operating arm 101 is a member in a stick shape or a pipe shape made of metal such as aluminum, plastic, or the like. A neck part side of the operating arm can be coupled, at a portion near its tip 104, to a coupling member 103 of the neck part with an appropriate method with a bolt and a nut and others. For example, as shown in FIG. 3, when the coupling member 103 is inserted in a notch provided at the tip of the operating arm 101, coupling can be easily achieved with a bolt and a nut. A handle 102 is annexed to the other end side of the operating arm 101. A neck-part operation support 108 is provided at a coupling part between a neck part 3 and a body part 4, and the neck part 3 moves in an interlocked manner with upward and downward movements of the handle 102, in a direction opposite to the movement of the handle. Also, when a head and mouth part 2 and the neck part 3 are coupled together so as not to be rotatable upward or downward, the head and mouth part 2 moves upward and downward in an interlocked manner with the movement of the neck part occurring due to the movement of the operating arm. In FIG. 2, the neck-part operation support 108 can be configured so as to be able to operate leftward and rightward. In this case, the neck part 3 moves in an interlocked manner with leftward and rightward movements of the handle 102, in a direction opposite to the movement of the handle.

Figure 4:
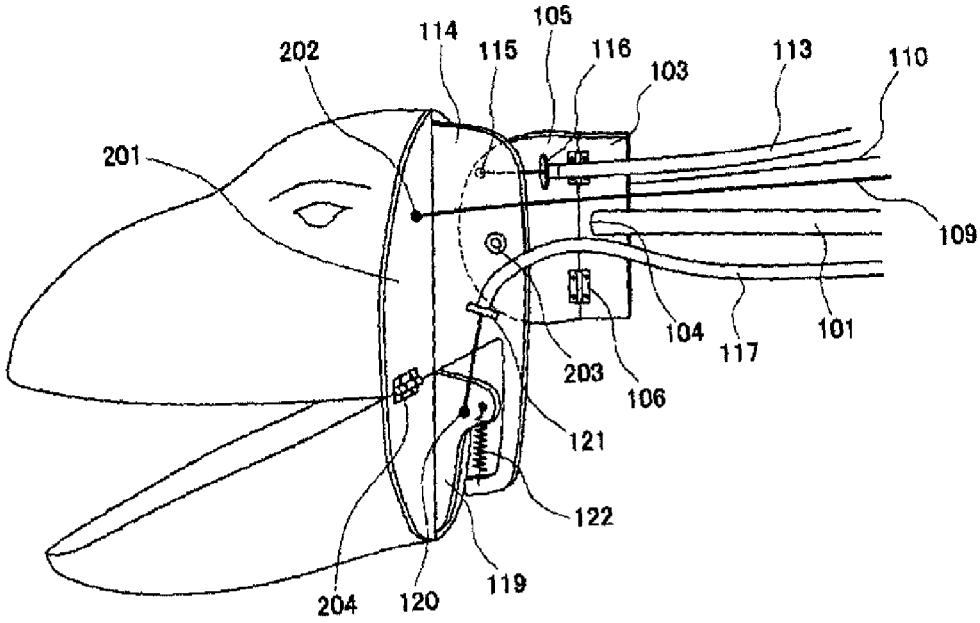
FIG. 4 is a view for describing means operating upward and downward movements of the head and mouth part and mouth-part operating means in the head-and-mouth-part operating means shown in FIG. 2.

In the present invention, preferable head-and-mouth-part operating means includes a wire (including a wire rope) extending from the head and mouth part to the hollow of the body part and a lever or a handle annexed to an end opposite to the head and mouth part. An example of means operating leftward and rightward movements of the head and mouth part is configured of paired left and right wires and an operating handle having these wires fixed to left and right, as shown in FIG. 2 to FIG. 4. Note that FIG. 3 is a view for describing means operating leftward and rightward movements of the head and mouth part, showing the state in which the wire and the head and mouth part are coupled together and the wire and the handle are coupled together. In FIG. 2, FIG. 3, and FIG. 4, a wire 109 has its tip fixed to a skeletal member 201 of a supermaxilla portion of the head and mouth part, and an end opposite thereto is fixed to an engaging point 111 of the operating handle 102. Similarly, a wire 110 is fixed to the skeletal member 201 of the supermaxilla portion and an engaging point 112 on an opposite side of the operating handle 102. When the operator rotates the operating handle for right hand leftward, the wire 109 is pulled to move the head and mouth part in a left direction with a hinge 106 as a movable point. Conversely, when the operator rotates the operating handle for left hand rightward, the wire 110 is pulled to move the head and mouth part in a right direction with the hinge 106 as a movable point.

Preferable means operating upward and downward movements of the head and mouth part includes a wire and a lever for use in a rim brake of a bicycle, as shown in FIG. 2 and FIG. 4. Note that FIG. 4 is a view for describing details of the means operating upward and downward movements of the head and mouth part and the means operating opening and closing of the mouth part. In FIG. 2, as a wire 113, a sheathed wire covered with a sheath made of metal or synthetic resin is preferably used. The wire extends from an operating lever 118 for upward and downward movements of the head part on a near side through the inside of the hollow and the neck part, and has its tip fixed to an upper portion of a wire installing member 114 provided on a neck part side of the head part. This wire installing member 114 is rotatably coupled to a coupling member 105. Also, the sheath of the sheathed wire is fixed, at a portion before the engaging point of the wire, to the coupling member 105. The coupling member 105 is coupled with a hinge that is not rotatable upward and downward to the coupling member 103 having the operating arm 101 fixed thereto. When the operating lever 118 for upward and downward movements of the head part is drawn in, the wire installing member 114 is pulled rearward, thereby causing the head and mouth part to rotate with a coupling portion 203 as a rotation axis and move in an upper direction. Then, when the operating lever 118 for upward and downward movements of the head part is released, the tension by the wire is loosened, and the wire installing member 114 rotates forward by the gravity of the head part, thereby causing the head and mouth part to return to an original position.

Preferable means operating opening and closing the mouth part includes, as with the means operating upward and downward movements of the head and mouth part, a wire and a lever for use in a rim brake of a bicycle. In FIG. 2, as a wire 117, a sheathed wire is preferably used. The wire extends from a mouth open/close operating lever 123 on a near side through the inside of the hollow and the neck part, and has it tip coupled to a movable piece 119 engaged with a submaxilla portion of the head and mouth part 2. The submaxilla portion and the supermaxilla portion of the head and mouth part 2 are coupled together with a hinge 204 so as to be able to be opened and closed as shown in FIG. 4. The sheath is fixed to the wire installing member 114. The wire installing member 114 and the movable piece 119 are coupled together with a spring 122 so that the mouth is in a closed state. When the operator draws the mouth open/close operating lever 123 in, the spring 122 extends via the movement of the wire, causing the submaxilla portion to move with the hinge 204 as a movable point to open the mouth. Then, when the operating lever for opening and closing the mouth is released, the tension by the wire is loosened, and the movable piece 119 returns to an original position with a restoring force of the spring 122, thereby closing the mouth. With appropriate use of the operating lever for opening and closing the mouth, the mouth can be opened and closed with a realistic movement.

The tail part of the costume suit is configured of a skeletal member and a skin member covering the skeletal member. The structure of the skeletal member is not restrictive as long as the structure can keep the outer shape. An example of structure is described in Patent Document 1. The tail part described in this Patent Document 1 has, as a skeletal member of the tail part, a soft plate-like member modeled after the skeleton of the tail part and arranged in a hollow portion of the inside of the tail part and a plurality of foam material blocks arranged as being fixed a predetermined space apart from each other to this plate-like member. An example of the soft plate-like member for use is made of plastic or rubber. These correspond to the skeleton of a portion of a tail of a large animal, and are arranged at a portion approximately along a center line in the hollow portion inside the tail part. For example, in the case of the tail part of a dinosaur, this plate-like member is configured to be gradually narrower (smaller) from a base of the tail to an end side of the tail. With this structure of the skeletal member of the tail part, the tail part moves in an interlocked manner with leftward and rightward movements of the body of the hind leg operator. Moreover, the tip of the tail moves greater, thereby achieving very realistic movements. Also, the structure described above is not restrictive, and the tail in a desired shape can be configured by using a synthetic resin foam (including one like a sponge).

To make the costume suit of the present invention more realistic, the leg parts can be configured to have a raised bottom. The raised bottom can be provided as appropriate according to the length of a leg of a large animal, and either one or both of the foreleg part and the hind leg part can have a raised bottom. In the case of a large animal such as a dinosaur, its hind leg is generally longer than its foreleg, and therefore the hind leg part preferably has a raised bottom. Also, when both of the leg parts have a raised bottom, the raised bottom of the hind leg part is preferably configured to be higher than that of the foreleg part. For example, in the case of a costume suit with its height of the body part (excluding the dorsal fin part) being approximately 3 m, the raised bottom of the foreleg part is configured on the order of 0 to 20 cm, and the raised bottom of the hind leg part is configured on the order of 30 cm to 50 cm. As such, with the leg part having a raised bottom, the costume suit more resembles the form of a large animal, and can realistically embody its movements.

The costume suit of the present invention includes a dorsal fin part, in addition to the head and mouth part, the neck part, the body part, the foreleg part, the hind leg part, and the tail part. With the provision of the dorsal fin part, the costume suit can be made as a more realistic large animal with dorsal fins. In the dorsal fin part, dorsal fin members as many as required can be provided to a skeletal portion corresponding to the back, and these members may be fixed and coupled by bonding. For convenience of conveyance and storage, however, it is preferable to removably connect these members.

A dorsal fin member is configured of a skeletal portion of dorsal fins and a skin portion covering the skeletal portion. As a material for forming the skeletal portion and the skin portion, the material for forming the body portion described above can also be used. The dorsal fin member can be provided at its lower end with a insertion portion for coupling, and can also be provided at its bottom with a coupling member such as a hook and loop fastener. On the other hand, the skeletal portion corresponding to the back of the body part can be provided with a mount receiving part for mounting the dorsal fin member. Also, at a position corresponding to the coupling portion provided on the bottom of the dorsal fin member, a similar coupling portion can be provided. With this structure, the dorsal fin member can be easily removed and attached, and the dorsal fin member can be removed when the large costume suit is carried.

In the costume suit of the present invention, at least part of the head and mouth part, the neck part, the body part, the foreleg part, the hind leg part, and the tail part can be disassemblably configured as required. For example, the costume suit can be configured to be disassemblable into the head and mouth part, the neck part, the body part, the foreleg part, the hind leg part, and the tail part. In particular, the tail part often has a long shape, and therefore is preferably configured to be separable from the body in consideration of convenience of conveyance and storage. A method of connecting each portion can be selected as appropriate and, normally, a method of connecting a coupling portion of each portion with a hinge or a bolt and a nut. An inlet/outlet of the costume suit for the operator can be provided as appropriate and, for example, a skin portion of an inseam portion of each of the left and right legs of the foreleg part and the hind leg part can be configured so as to be openable and closeable by using a fastener.

The costume suit of the present invention has a mission of moving around as being modeled after the movement of an animal. The costume suit is manipulated by two operators fitting in the hollow, and this manipulation can be performed while a video shot by a front monitoring camera installed at an appropriate position on the costume suit for monitoring forward is being checked on a monitor installed in the hollow. Also, if it is possible to check, on another monitor installed in the hollow, a video shot at a position from which the state of the surroundings of a place with the costume suit can be viewed, the costume suit can be manipulated more safely. Furthermore, if means allowing intercommunication between a guide staff outside and the operators, for example, a wireless communicator, is provided, manipulation can be made based on an instruction from the guide staff.

The front monitoring camera is preferably mounted at a position where the state in a traveling direction can be known, for example, at a position in any of the head and mouth part, the neck part, or the body part, the position not being conspicuous from the surroundings. The position is preferably in the vicinity of the coupling portion between the neck part and the body part, as shown in FIG. 1. The monitors can be installed by using a monitor installing member. When the skeletal member has a backbone made of wood, the monitor installing member is preferably fixed to that wood for the backbone. In that case, if the monitor installing member is unstable, a reinforcing member coupling the monitor installing member and the skeletal member of the body part can be mounted for stabilization.

When two independent hollows are provided for the foreleg part and the hind leg part, separate monitor installing members are required for the foreleg operator and the hind leg operator. When a single hollow is provided to make the foreleg operator and the hind leg operator face each other, a monitor installing member is mounted as being fixed to the skeletal member at a position approximately in the middle between the foreleg part and the hind leg part. Using this member, the monitors for the foreleg-part operator and the hind leg-part operator can be efficiently installed. Also on the monitor installing member, a battery, an ammeter/voltmeter, a switch, and others can be mounted as appropriate.

EXAMPLE

While a specific example of the present invention is described below with reference to the drawings, the present invention is not meant to be restricted by this example.

FIG. 1 shows an overview of a costume suit 1 modeled after a quadrupedal dinosaur, which is a specific example of a large animal, being rendered so that the inner structure of the costume suit 1. Note that a skeletal member of the costume suit 1 is partially omitted. The costume suit 1 has the head and mouth part 2, the neck part 3, the body part 4, the foreleg part 5, the hind leg part 6, a tail part 7, and a dorsal fin part 8. The body part 4 and the foreleg part 5 and the hind leg part 6 form a single hollow 9 inside. The foreleg part and the hind leg part each have a hollow with a size allowing a foreleg operator 26 and a hind leg operator 27 to fit in as standing upright. FIG. 1 shows the state in which two operators 26 and 27 fitting in the hollow 9 carry frame packs 14 and 16, respectively, on their backs.

The head and mouth part 2, the neck part 3, the tail part 7, and the dorsal fin part 8 of the costume suit 1 are each configured to be separable from another portion, and the body part 4, the foreleg part 5, and the hind leg part 6 are integrally configured. The body part and the neck part are coupled together at a coupling surface 11, and the body part and the tail part are coupled together at a coupling surface 12. The head and mouth part 2 and the neck part 3, and the body part 4 and the dorsal fin part 8 are also coupled together with an appropriate methodology (not shown). The costume suit 1 has a skeletal member 10 and a skin member (not shown) covering the skeletal member, and the skeletal member is made of wood and a synthetic-resin foam material (including one like a sponge). Also, the skin member is made of an elastic material in combination of a resin-made thin film and a polyurethane foam.

On a head side of the hollow 9, a frame-pack support member for the foreleg operator 13 is provided as being coupled to the skeletal member 10 at the body part 4, and has a frame pack for the foreleg operator 14 fixed thereto. Also, on a tail side of the hollow 9, a frame-pack support member for the hind leg operator 15 is provided as being coupled to the skeletal member 10 at the body part 4, and has a frame pack for the hind leg operator 16 fixed thereto. The frame-pack support member for the foreleg operator 13 is coupled to the coupling surface 11 with a reinforcing member 17 so as to be stabilized. Similarly, the frame-pack support member for the hind leg operator 15 is coupled to the coupling surface 12 with a reinforcing member 18.

The hind leg part 6 is configured to have a raised bottom 19, and a front monitoring camera 20 is installed on the body part 4 near the neck part 3. The tail part 7 has a structure identical to that shown in FIG. 3 of Patent Document 1, in which a plate-like member 21 arranged approximately at a center portion inside the hollow and a plurality of foam material blocks 22 arranged a predetermined space apart from each other thereto form a skeletal member. At a position approximately in the middle of the hollow 9, a monitor installing member 23 is provided as being coupled to the skeletal member 10 at the body part 4, and a monitor for the foreleg operator 24 and a monitor for the hind leg operator 25 are installed at the monitor installing member 23.

In the dorsal fin part 8, a dorsal fin member provided at its lower end with a coupling insertion member is inserted in a receiving part provided in the skeletal ember at the body part 4 for the dorsal fin member, thereby being coupled so as to disassemblable (not shown). The costume suit 1 measures approximately 7 m in full length (including the tail part), the height of the body part 4 (including the dorsal fin part 8) is approximately 4 m, and the hind leg part 6 has the raised bottom 19 of approximately 40 cm.

The costume suit 1 includes neck-part operating means for operating a movement of the head and mouth part 2 and the neck part 3. In FIG. 2, 101 denotes an operating arm extending from the neck part 3 to the hollow 9 of the body part 4, 102 denotes an approximately U-shaped operation handle coupled to the operating arm. The operating arm 101 is a member in a stick or pipe shape made of metal such as aluminum, plastic, or the like. The operating arm 101 penetrates through the coupling surface 11 between the neck part 3 and the body part 4, and is fixed, at a portion near its tip 104, to the coupling member 103 on a neck part side coupling the head and mouth part 2 and the neck part 3 together. The coupling member 103 is fixed to the coupling member 105 with the hinge 106 so as not to be rotatable upward or downward. The other end of the operating arm is fixed at a center part 107 of the operating handle 102. The neck-part operation support 108 is provided to a coupling part between the neck part 3 and the body part 4. The neck part 3 operates in an interlocked manner with upward and downward movements of the operating handle 102 in a direction opposite to the movement of the operating handle. Also, since the hinge 106 not allowing upward and downward rotation is used in this example, the head and mouth part operates upward and downward in an interlocked manner with the movement of the neck part.

Also, the costume suit 1 includes head-and-mouth-part operating means operating leftward and rightward movements of the head and mouth part 2, the means having the pair of wires 109 and 110 extending from the head and mouth part 2 to the hollow 9 of the body part 4 and the approximately U-shaped operating handle 102. In FIG. 2 to FIG. 4, a head-side tip of the left wire 109 of the costume suit is fixed at an engaging point 202 provided on a left side of the skeletal member 201 of the supermaxilla portion of the head and mouth part 2, and its opposite end is fixed at the engaging point 111 on a left side (a near side in FIG. 2) of the operating handle 102. Similarly, the right wire 110 is fixed to the skeletal member 201 of the supermaxilla portion (not shown), and its opposite end is fixed at the engaging point 112 of the operating handle. When the foreleg operator 26 rotates the operating handle 102 for right hand leftward, the wire 109 is pulled to move the head and mouth part 2 in a left direction with the hinge 106 as a movable point. Conversely, when the operating handle for left hand is rotated rightward, the wire 110 is pulled to move the head and mouth part in a right direction with the hinge 106 as a movable point.

Furthermore, the costume suit 1 includes head-and-mouth-part operating means for operating upward and downward movements of the head and mouth part, the means having a wire extending from the head and mouth part 2 to the hollow 9 of the body part 4 and an operating lever annexed to an end opposite to the head and mouth part. In FIG. 2 and FIG. 3, the wire 113 is provided with a sheath, and has a tip fixed at an engaging point 115 provided to an upper portion of a wire installing member 114 provided on a neck part side of the head and mouth part 2. This wire installing member 114, together with a plate-like member 114' provided to face each other, is rotatably coupled at the coupling portion 203 to the coupling member 105 of the head and mouth part 2. Also, the tip of the sheath of the sheathed wire is fixed at an engaging point 116 of the coupling member 105 on a neck side from the engaging point 115 of the wire. The neck coupling member 103 and the head-and-mouth-part coupling member 105 are rotatable leftward and rightward, and are coupled with the hinge 106 not rotatable upward and downward. When the operating lever 118 for upward and downward movements of the head part is drawn in, the wire installing member 114 is pulled backward by tension of the wire, the head and mouth part 2 is rotated with the coupling portion 203 between the wire installing member 114 and the head-and-mouth-part coupling member 105 being taken as a rotation axis to move upward. Then, when the operating lever 118 is released, the tension by the wire is loosened, and the wire installing member 114 rotates forward by the gravity of the head part, thereby causing the head and mouth part to return to an original position.

The costume suit 1 includes mouth-part operating means for operating a movement of opening and closing a mouth of the head and mouth part, the means having a wire extending from the head and mouth part 2 to the hollow of the body part 4 and an operating lever annexed to an end opposite to the head and mouth part 2. In FIG. 2 and FIG. 4, a wire 117 is provided with a sheath, and has a tip fixed at an engaging point 120 provided at the movable piece 119 engaged with a submaxilla portion of the head and mouth part 2. Also, the tip of the sheath is fixed at an engaging point 121 provided to the wire installing member 114. The wire installing member 114 and the movable piece 119 are coupled together with the spring 122 so that the mouth is closed. When the foreleg operator 26 draws the mouth open/close lever 123 in, the spring 122 extends via the movement of the wire 117, causing the submaxilla portion to move with the hinge 204 as a movable point to open the mouth. Then, when the mouth open/close lever 123 is released, the tension by the wire is loosened, and the mouth returns to be in a closed state with a restoring force of the spring 122. By adjusting the operation of the mouth open/close lever 123 as appropriate, the movements of opening and closing the mouth can be realistically made.

The skeletal member at the tail part 7 of the costume suit 1 is configured of the plate-like member 21 made of soft plastic and arranged approximately at a center portion of a hollow portion inside the tail part, and the plurality of polystyrene-foam-material blocks 22 arranged as being fixed a predetermined space apart from each other to the plate-like member 21. With this structure, a natural movement as the tail part can be expressed only with the hind leg operator 27 moving his or her body leftward and rightward.

In the costume suit 1 of FIG. 1, the monitor installing member 23 is provided as being coupled to the skeletal member 10 at the body part 4. The monitor installing member 23 is fixed to the skeletal member 10 corresponding to a back portion at a position approximately in the middle between the foreleg part 5 and the hind leg part 6 in the hollow 9. By using the monitor installing member 23, the monitors for the foreleg operator and the hind leg operator 24 and 25 are installed. While only these monitors are shown in FIG. 1, a battery, an ammeter/voltmeter, an external camera video receiver, a switch, and others can be installed as appropriate.

INDUSTRIAL APPLICABILITY

In the present invention, the inner structure of the costume suit allows two operators to fit in. This can provide a costume suit of a large size, which cannot be realized with a conventional costume suit for a single operator. Furthermore, realistic movements as ever can be achieved. Therefore, owing to the realistic movements, the costume suit of the present invention can not only be used at entertainment shows in amusement parks, theme parks, television programs, or the like, but also be widely used for theatrical performances on stage and special effects in movies.

The invention claimed is:

1. A large-quadrupedal-animal costume suit capable of making a realistic movement and modeled after a large quadrupedal animal, the costume suit having a head and mouth part, a neck part, a body part, a foreleg part, a hind leg part, and a tail part and being configured, as a whole, a skeletal member and a skin member covering the skeletal member, wherein the body part, the foreleg part, and the hind leg part communicate with each other to form a single hollow, the hollow has a size allowing a foreleg operator fitting in the foreleg part and a hind leg operator fitting in the hind leg part to fit in as standing upright, frame-pack support members for the foreleg operator and the hind leg operator are installed in the hollow as being fixed to the skeletal member at the body part, a frame pack for the foreleg operator is installed on the frame-pack support member provided on a head side of the hollow, and a frame pack for the hind leg operator is installed on the frame-pack support member provided on a tail side of the hollow so as to face the frame pack for the foreleg operator.

2. The large-quadrupedal-animal costume suit according to claim 1, comprising neck-part operating means for operating a movement of the head and mouth part and the neck part, the neck operating means having an operating arm extending from the neck part to the hollow of the body part and an operation handle coupled to the operating arm.

3. The large-quadrupedal-animal costume suit according to claim 2, comprising head-and-mouth-part operating means for operating a movement of the head and mouth part, the head-and-mouth-part operating means having a wire extending from the head and mouth part to the hollow of the body part and an operation lever or an operation handle annexed to an end opposite to the head and mouth part.

4. The large-quadrupedal-animal costume suit according to claim 1, comprising head-and-mouth-part operating means for operating a movement of the head and mouth part, the head-and-mouth-part operating means having a wire extending from the head and mouth part to the hollow of the body part and an operation lever or an operation handle annexed to an end opposite to the head and mouth part.

5. The large-quadrupedal-animal costume suit according to claim 1, comprising mouth-part operating means for operating opening and closing of a mouth of the head and mouth part, the mouth-operating means having a wire extending from the head and mouth part to the hollow of the body part and an operation lever annexed to an end opposite to the head and mouth part.

6. The large-quadrupedal-animal costume suit according to claim 1, wherein at least one of the leg parts is configured to have a raised bottom.

7. The large-quadrupedal-animal costume suit according to claim 1, wherein a front monitoring camera is installed at the head and mouth part, the neck part, or the body part, and a monitor for front monitoring that displays a video of the front monitoring camera is installed at a monitor installing member in the hollow.

8. The large-quadrupedal-animal costume suit according to claim 7, wherein an external downward view monitor that displays a video of an area surrounding the costume suit is installed at the monitor installing member.

9. The large-quadrupedal-animal costume suit according to claim 7, wherein the monitor installing member is installed as being fixed to the skeletal member at the body part between the foreleg part and the hind leg part, and monitors for front monitoring for the foreleg operator and the hind leg operator and the external downward view monitor that is provided as desired are installed at the monitor installing member.

10. The large-quadrupedal-animal costume suit according to claim 1, wherein the large animal is a dinosaur.

* * * * *